US012778377B2

(12) United States Patent
Disch et al.

(10) Patent No.: US 12,778,377 B2
(45) Date of Patent: Nov. 3, 2026

(54) DISHWASHER WITH HEAT RECOVERY APPARATUS

(71) Applicant: ILLINOIS TOOL WORKS INC., Glenview, IL (US)

(72) Inventors: Harald Disch, Elzach (DE); Martin Schrempp, Biberach (DE)

(73) Assignee: ILLINOIS TOOL WORKS INC., Glenview, IL (US)

( * ) Notice: Subject to any disclaimer, the term of this patent is extended or adjusted under 35 U.S.C. 154(b) by 79 days.

(21) Appl. No.: 19/047,242

(22) Filed: Feb. 6, 2025

(65) Prior Publication Data

US 2025/0255456 A1 Aug. 14, 2025

(30) Foreign Application Priority Data

Feb. 8, 2024 (EP) ..... 24156524

(51) Int. Cl.

| | |
|---|---|
| ***A47L 15/00*** | (2006.01) |
| ***A47L 15/24*** | (2006.01) |
| ***A47L 15/42*** | (2006.01) |
| ***A47L 15/48*** | (2006.01) |
| ***F25B 30/02*** | (2006.01) |

(52) U.S. Cl.

CPC ..... *A47L 15/4291* (2013.01); *A47L 15/0076* (2013.01); *A47L 15/241* (2013.01); *A47L 15/4285* (2013.01); *A47L 15/483* (2013.01); *A47L 15/486* (2013.01); *A47L 15/488* (2013.01); *F25B 30/02* (2013.01)

(58) Field of Classification Search

None

See application file for complete search history.

(56) References Cited

U.S. PATENT DOCUMENTS

| | | | |
|---|---|---|---|
| 10,433,703 | B2 | 10/2019 | Disch |
| 2017/0000310 | A1* | 1/2017 | Disch ..... A47L 15/24 |

FOREIGN PATENT DOCUMENTS

| | | | |
|---|---|---|---|
| CN | 106691348 | B | 11/2019 |
| CN | 114903397 | A | 8/2022 |
| DE | 102013224440 | A1 | 5/2015 |

* cited by examiner

*Primary Examiner* — Levon J Shahinian

(74) *Attorney, Agent, or Firm* — THOMPSON HINE LLP

(57) ABSTRACT

A dishwasher includes a heat recovery apparatus to recover at least a portion of the thermal energy of discharged exhaust air as utility heat and transfer it to a treatment liquid to be sprayed in the dishwasher. The heat recovery apparatus includes a primary circulation system having a heating pump assembly and a first secondary circulation system with a first heat exchanger unit configured such that at least a portion of the recovered energy is transferred to a carrier medium circulating in the first secondary circulation system. The first secondary circulation system includes a second heat exchanger unit configured such that at least a portion of the energy transferred to the carrier medium is transferred as utility heat for warming the treatment fluid to a refrigerant of the heating pump assembly of the primary circulation system, the drying air circulating in the primary circulation system.

17 Claims, 1 Drawing Sheet

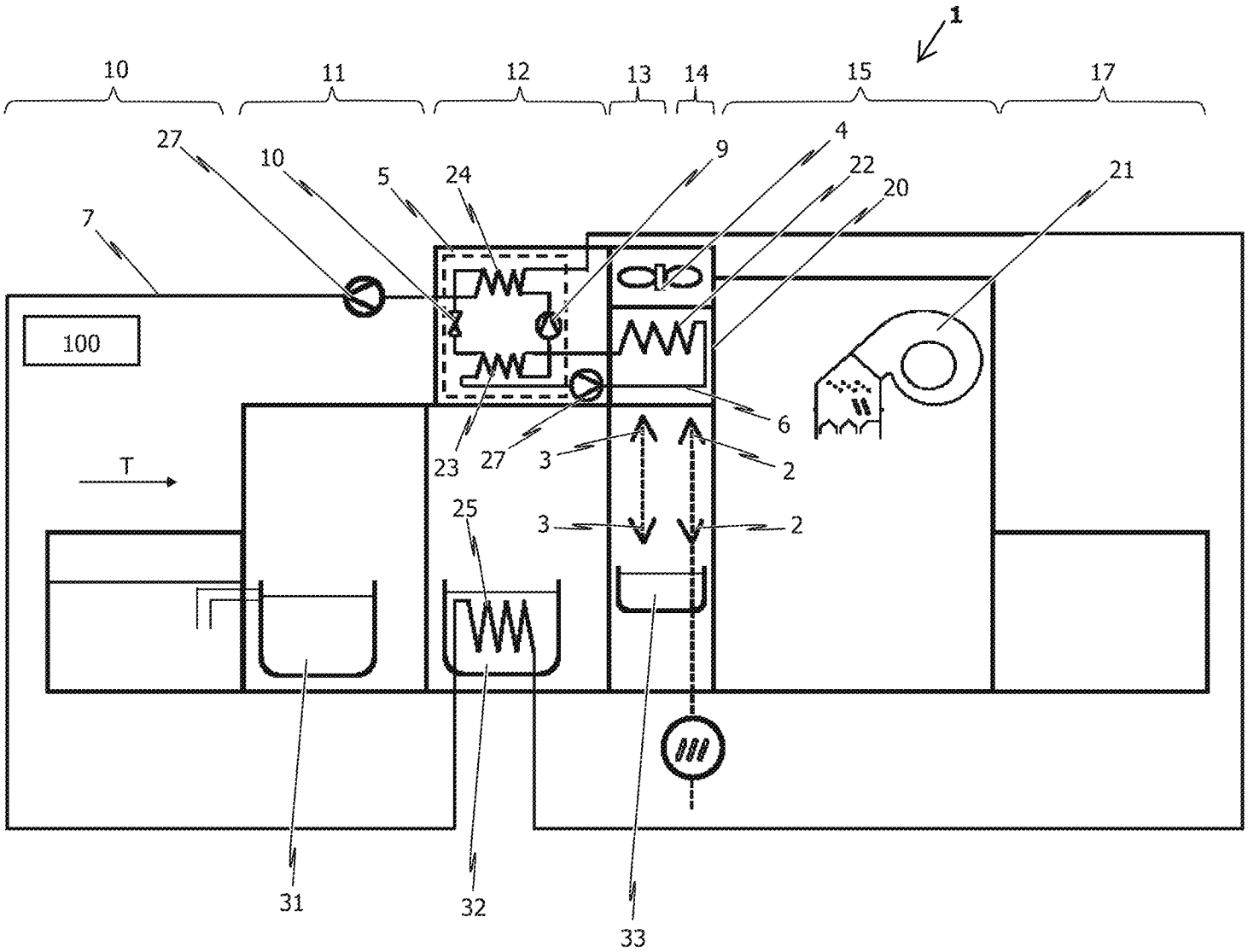
1
10
11
12
13
14
15
17
21
20
22
4
9
6
2
2
3
3
27
23
24
5
10
27
7
100
T
25
32
31
33

DISHWASHER WITH HEAT RECOVERY APPARATUS

TECHNICAL FIELD

The present invention relates generally to the field of commercial washing, in particular. Specifically, the present invention relates to a dishwasher, in particular commercial dishwasher, which is configured as a box-type dishwasher or as a conveyor dishwasher.

BACKGROUND

According to one aspect of the invention, this relates in particular to a conveyor dishwasher having a conveyor apparatus for conveying washware through the individual treatment zones of the conveyor dishwasher, wherein the conveyor dishwasher comprises at least one washing zone in which washing liquid from a washing tank associated with the washing zone is sprayed onto the washware. The conveyor dishwasher according to this aspect of the invention further comprises at least one rinsing zone arranged behind the at least one washing zone when viewed in the conveying direction of the washware, in which rinsing zone rinsing liquid is sprayed onto the washware. Furthermore, the conveyor dishwasher comprises an exhaust system for removing exhaust air from the conveyor dishwasher that is produced during operation of the machine.

A conveyor dishwasher according to the present invention is, in particular, a slight-type dishwasher or a rack conveyor dishwasher.

A conveyor dishwasher of the aforementioned type is known in principle from the prior art and is typically used in the commercial realm. In contrast to so-called box-type dishwashers, in which the washware to be cleaned remain stationary in the machine during cleaning, in conveyor dishwashers the washware are conveyed through different treatment zones of the conveyor dishwasher.

A conveyor dishwasher typically comprises as treatment zones at least one pre-washing zone and at least one main washing zone located downstream of the pre-washing zone(s) when viewed in the conveying direction of the washware. When viewed in the conveying direction, at least one rinsing zone is typically arranged downstream of the main washing zone(s).

It is also known to provide at least one additional post-washing zone or pre-rinsing zone between the main washing zone and the rinsing zone.

When viewed in the conveying direction of the washware, the washware which has either been received directly on the conveyor belt or is held by racks typically travels through an inlet tunnel, the subsequent pre-washing zone(s), main washing zone(s), post-washing zone(s) if provided, rinsing zone(s), a drying zone, and into an outlet path.

The aforementioned washing zones of the conveyor dishwasher (pre-washing zone(s), main washing zone(s), and, if provided, post-washing zone(s)) are each associated with a washing system comprising a washing pump and a conduit system connected to the washing pump, via which washing liquid is fed to respective spraying nozzles of the washing zones. The washing liquid fed to the spraying nozzles is sprayed onto the washware in the respective washing zone, which is conveyed by a conveyor apparatus of the conveyor dishwasher through the respective washing zones.

Each washing zone has an associated washing tank in which sprayed liquid is received and/or in which liquid for the spraying nozzles of the respective zones is provided.

In conveyor dishwashers known from the prior art, rinsing liquid in the form of fresh water, which can be pure or can be mixed with further additives such as a rinsing agent, is sprayed via the spraying nozzles of the rinsing zone onto the washware. At least a portion of the sprayed rinsing liquid is conveyed from treatment zone to treatment zone in a cascading system counter to the conveying direction of the washware.

The sprayed rinsing liquid is collected in a tank (post-washing tank) of the post-washing zone, from which it is conveyed via the washing pump system of the washing system belonging to the post-washing zone to the spraying nozzles (post-washing nozzles) of the post-washing zone. In the post-washing zone, washing liquid is rinsed off of the washware. The resulting liquid flows into the washing tank of the at least one main washing zone, which is upstream of the post-washing zone when viewed in the conveying direction of the washware. Here, a cleaning agent is typically added to the liquid, and then the liquid is sprayed onto the washware by a pumping system belonging to the washing system of the main washing zone (washing pump system) via the nozzles (washing nozzles) of the main washing zone.

From the washing tank of the main washing zone, the liquid then flows into the pre-washing tank of the pre-washing zone, unless a further main washing zone is provided. The liquid in the pre-washing tank is sprayed onto the washware by a pumping system belonging to the washing system of the pre-washing zone via the pre-washing nozzles of the pre-washing zone, in order to remove coarse impurities from the washware.

In the field of commercial dishwashing, there are different standards and guidelines that define the hygiene performance requirements of cleaning processes and their procedural inspections. All standards and guidelines have in common that, during the cleaning process, minimum temperatures are required for the washing and rinsing zones of the commercial dishwasher. In this way, at least a partial thermal disinfection is to take place, among other things.

The requirements with respect to the specified minimum temperatures in the relevant treatment zones of the conveyor dishwasher result in the use of a relatively large amount of energy in the operation of the commercial dishwasher in order to heat the washing or rinsing liquids to the required minimum temperatures. On the other hand, in currently known conveyor dishwashers, up to 55% of the energy introduced during operation of the conveyor dishwasher is discharged as waste heat in the form of wastewater and exhaust air.

The problem discussed above with reference to a conveyor dishwasher, namely that, during the operation of the dishwasher, a majority of the energy introduced during operation of the machine is released as waste heat in the form of wastewater and exhaust air, also exists in the case of dishwashers, in particular commercial dishwashers, which are configured as a box-type dishwasher.

Box-type dishwashers are manually loadable and unloadable dishwashers. The box-type dishwashers (also referred to as "batch dishwashers") can be tableware rack sliding dishwashers ("hood-type dishwashers") or front loaders ("front loader dishwashers"). Front loaders can be under-counter machines, top-counter machines, or free-standing front loaders.

A dishwasher configured as a box-type dishwasher typically comprises a treatment chamber for the cleaning of washware. Typically, a washing tank is arranged below the treatment chamber, in which liquid can flow back from the treatment chamber due to gravity. In the washing tank, there is washing liquid, which is typically water, to which a cleaning agent can be added.

A dishwasher configured as a box-type dishwasher typically further comprises a washing system having a washing pump, a conduit system connected to the washing pump, and a nozzle system having at least one washing nozzle. The washing liquid located in the washing tank can be conveyed from the washing pump via the conduit system to the washing nozzles and, through the washing nozzles, sprayed onto the washware to be cleaned in the treatment chamber. The sprayed washing liquid subsequently flows back into the washing tank.

Such a dishwasher configured as a box-type dishwasher is known, for example, from the publication DE 10 2005 023 429 A1.

In particular, the term "washware" as used herein should be understood to refer to crockery, glasses, cutlery, cooking utensils, oven utensils, and serving trays.

A commercial dishwasher configured as a box-type dishwasher differs from a domestic dishwasher in particular in that a commercial dishwasher must be designed in such a way that, depending on the cleaning program selected, cycle times of between one and five minutes can be realized, while domestic dishwashers typically have run times of up to 2.5 hours or more. Due to the short program duration required for commercial dishwashers, household dishwasher techniques are not readily transferable to commercial dishwashers.

Commercial dishwashers configured as box-type dishwashers typically operate in two main process steps: a first step involving washing with a washing liquid and a second step involving rinsing with heated fresh water and dosed rinsing aid.

In order to perform these process steps, a commercial dishwasher configured as a box-type dishwasher is typically equipped with two independent liquid systems that are completely separated from one another. The one liquid system is a washing water circuit which is responsible for washing the washware, wherein the washing is carried out with circulated water from the washing tank of the dishwasher. The other liquid system is a fresh water system, which is responsible for rinsing. The rinsing is carried out with fresh water, preferably fresh water from a boiler. After spraying, the fresh water is likewise taken into the washing tank of the dishwasher.

The primary task of rinsing is to remove any remaining lye on the washware. The rinsing water flowing in the washing tank during the rinsing step is additionally used in order to regenerate the washing water in the washing tank.

Before fresh water is sprayed as a rinsing liquid during the rinsing and thereby fed into the washing tank of the dishwasher, a quantity of washing liquid equal to the quantity of fresh water is pumped out of the washing tank.

Typically, commercial dishwashers configured as box-type dishwashers are equipped with a plurality of programs. These programs are distinguished primarily by different lengths of program run times of the washing process. The operator has the option of selecting a short washing program for lightly soiled washware or a correspondingly longer washing program for heavily soiled washware.

Commercial dishwashers configured as box-type dishwashers for batch-wise loading and unloading of the treatment chamber with washware are, in particular, front loaders or rack sliding machines. For front loaders, the washware is placed in a rack, and the rack loaded with washware is placed in the treatment chamber of the dishwasher through a front door and removed again through the front door after cleaning. In rack sliding machines, the tableware racks loaded with washware are manually pushed from an input side into the treatment chamber and, after completion of a washing program, manually removed from an output side of the treatment chamber. Front loaders and rack sliding machines contain only a single treatment chamber for treating the washware. The front loaders can be under-counter machines or table-top machines.

Commercial dishwashers that are designed as box-type dishwashers mainly use two drying methods. In the first method, the washware that is still hot after the rinsing process is removed from the machine, where it then dries in the ambient air for four to ten minutes. In the aforementioned method, in order to dry the washware, it is usually left in the racks in which it was placed for cleaning in the dishwasher.

According to the second method, air drying occurs within the treatment chamber of the dishwasher. Here, fresh air drying systems are used. Such fresh-air drying systems for commercial front loaders or under-counter dishwashers always operate at a high airflow rate in the range of 25 to 100 $m^3$ per hour in order to allow the washware remaining in the treatment chamber to dry in a very short time. The high airflow rates are due to the brevity of the drying process in the commercial field. Compared to conventional drying of a domestic dishwasher, the active drying time of a commercial dishwasher is many times shorter. While programmed run-time drying in a domestic dishwasher is approximately 30 minutes to 2.5 hours, programmed run-time drying in commercial use is between 1.5 and 5 minutes.

During air-drying in a commercial dishwasher configured as a box-type dishwasher, fresh air is drawn in from the outside and passed through the treatment chamber of the dishwasher in order to take up moisture from the washware to be dried. Typically, the drying air loaded with moisture is then blown out as exhaust air into the room where the dishwasher is installed.

In particular in kitchens where a plurality of dishwashers configured as a box-type dishwasher are operated at the same time, blowing the drying air into the room leads to a negative impact on the room climate, because, due to the blowing of drying air loaded with moisture and warm drying air in comparison to the air in the room, the moisture content of the air in the room (ambient air) is necessarily increased. In particular, there is a risk that the moisture content of the air in the room is increased to the extent that undesirable condensation of water vapor occurs, in particular on cool interfaces in the room.

Apart from this, the shortened drying time required for box-type dishwashers necessarily comes with increased energy consumption in order to heat the drying air accordingly.

In order to conserve resources, in particular energy, in the operation of a dishwasher, whether it is a machine designed as a box-type dishwasher or as a conveyor dishwasher, it is already known from the prior art to use wastewater and exhaust air heat recovery systems with which at least a portion of the kinetic energy of the wastewater and/or the exhaust air of the machine can be recovered as utility heat.

In this regard, for example, reference is made to the publication DE 10 2014 208 813A1, which relates to a conveyor dishwasher with a heat recovery apparatus.

In the conveyor dishwasher known from this prior art, a heating pumping device is used as the exhaust air heat recovery system. With the aid of this heating pumping device, a portion of the kinetic energy of the exhaust air of the conveyor dishwasher is transferred to a refrigerant circulating in the heating pumping device. In so doing, the kinetic energy to be recovered is take up by vaporizing the refrigerant at low pressure in a vaporizer device. The gaseous refrigerant is subsequently condensed by a condenser unit to a higher pressure level and then liquefied in a liquefying unit at a high temperature. The refrigerant is then relaxed back to the vaporization pressure again with the aid of an expansion valve device. The liquefaction temperature of the refrigerant in the liquefying unit is used in order to heat the rinsing liquid or washing liquid of the conveyor dishwasher. For this purpose, a corresponding heat exchanger is provided in the rinsing liquid tank or washing liquid tank.

Thus, the heat pumping technology represents an effective method for recovering the energy stored in the moist exhaust air of a dishwasher. The moist airflow of the exhaust air of the dishwasher can be guided via a vaporizer device of a cooling system, as a result of which the machine exhaust air is cooled to the ambient level. Through the energy transfer, the refrigerant of the heating pump evaporates and, after complete evaporation and overheating in the gaseous state by the heating pump compressor, is condensed and brought to a higher pressure and temperature level. On the high-pressure side, the energy is output as heat to the washing, rinsing, and/or drying zone of the conveyor dishwasher, and in doing so condenses, liquefies, and subcools the refrigerant before it is released via an expansion valve, and thereby a lower pressure level is reached.

The heat pumping technology makes it possible to fully recover the energy contained in the exhaust air and thereby supply the exhaust air to the installation room (kitchen) in an energetically neutral manner. Thus, an on-site exhaust system is not required, because the exhaust air of the machine can be supplied directly to the room.

The exhaust air heating pumps currently in use are operated with the refrigerants R513a in Europe and R450a in North America. Compared to the previously used refrigerant R134a, these two refrigerants already have a significantly better GWP value of 631 and 605 compared to 1,430 at R134a.

"GWP" is the abbreviation for "Global Warming Potential," meaning the global warming or greenhouse gas potential of a substance. The GWP value of a refrigerant defines its relative greenhouse gas potential with respect to $CO_2$ (also referred to as $CO_2$ equivalent).

The refrigerants used thus far in heating pumps, in particular R513a and R450a, are also not harmless for various reasons of environmental and climate protection, because they still have a significant greenhouse effect.

Accordingly, there is an effort to develop a wastewater and/or exhaust air heat recovery system of an in particular commercial dishwasher, wherein the wastewater and/or exhaust air heat recovery system has as few potential negative environmental effects as possible.

In comparison to, for example, the refrigerant R513a or the refrigerant R450a, natural refrigerants, such as propane (R290a) or isobutane (R600a), have the advantage that their GWP value is significantly lower at 3 in each case; however, these refrigerants are slightly flammable in contrast to R513a and R450a, which, considering the operational safety of the system, carries some important changes to the known heating pumping concept of commercial dishwashers.

Here, it must be taken into account that heating pump systems with natural refrigerants, in particular hydrocarbons (such as propane R290a or isobutane R600a), may only be used in confined spaces, if at all.

Hydrocarbons are combustible and are classified as part of safety group A3 in accordance with DIN EN 378-1:2016+A1:2020. According to the current product safety standard DIN EN 60335-2-40:2014-01, combustible refrigerants can only be used indoors at lower capacities and with a very low amount of cold filling (regardless of the size of the room). For larger filling amounts, special measures are required, for example forced venting.

Therefore, hydrocarbons are currently only used in lower-power heating pumps and, above all, in outdoor heating pumps. In the outdoors, filling amounts of up to 5 kg are permitted.

The natural refrigerant R744 ($CO_2$) is characterized due to its thermodynamic properties by high performance figures in use in domestic water heating pumps, whereas the potential for use in heating pumps for dishwashers is limited by the above-critical heat release. For $CO_2$ heating pumps, the energy efficiency is lower with lower temperature spreads, such as for the recovery of exhaust heat. Both R744 ($CO_2$) and R717 (ammonia) are used primarily in larger power ranges and currently have little relevance for heating pumps in dishwashers.

SUMMARY

The problem addressed by the present invention is to specify a dishwasher, in particular a commercial dishwasher, having an exhaust air and/or waste heat recovery system, wherein the exhaust air/wastewater heat recovery system does not have the same problems relating to the environment and climate protection described in the case of the refrigerants R513a and R450a which have typically been used thus far, and wherein at the same time the heat recovery system can be used indoors or in a kitchen without additional structural measures.

Accordingly, the invention relates in particular to a dishwasher, in particular a commercial dishwasher, which is configured as a box-type dishwasher and preferably as a conveyor dishwasher. The dishwasher comprises a heat recovery apparatus, configured so as to recover at least a portion of the thermal energy of the exhaust air discharged or to be discharged from the dishwasher as utility heat during operation of the dishwasher and to transfer said thermal energy to at least one treatment liquid to be sprayed in the dishwasher, and/or to a drying air used for drying in the dishwasher. The at least one treatment liquid to be sprayed in the dishwasher is in particular washing liquid and/or rinsing liquid.

The solution according to the invention is characterized in particular in that the heat recovery apparatus is subdivided into different circulation systems, wherein it is ensured that a refrigerant circulating in one of the circulation systems can leak out due to, for example, a defect, a leakage, or a faulty operation and accumulate in the dishwasher.

Specifically, it is provided according to the invention that the heat recovery apparatus comprises a primary circulation system having a heating pump assembly and a first secondary circulation system. The first secondary circulation system comprises a first heat exchanger unit, which is configured such that at least a portion of the energy to be recovered from the exhaust air of the dishwasher is or can be transferred into a fluid, in particular a liquid, carrier medium circulating in the first secondary circulation system.

The first secondary circulation system further comprises a further, second heat exchanger unit, which is configured such that at least a portion of the thermal energy transferred to the (fluid and in particular liquid) carrier medium circulating in the first secondary circulation system via the first heat exchanger unit of the first secondary circulation system is or can be transferred into a refrigerant circulating in the primary circulation system of the heating pump assembly of the primary circulation system as utility heat for warming the at least one treatment liquid to be sprayed in the dishwasher and/or for warming the drying air.

The advantages achievable with the solution according to the invention are clear: in particular, the division of the heat recovery apparatus into a primary circulation system on the one hand and a first secondary circulation system on the other hand allows for a natural hydrocarbon-based refrigerant, such as propane (R290a), isobutane (R600a), or propene (R441), to be used as the refrigerant circulating agent circulating in the primary system. The natural refrigerants have the advantage, for example in comparison to the refrigerant R513a or to the refrigerant R450a, that their GWP value is significantly lower at 3 in each case.

Natural and hydrocarbon-based refrigerants have the disadvantage, in comparison to for example R513a and R450a, that they are highly flammable, which carries some important changes to the known heating pump design for commercial dishwashers in terms of operational safety for the system/dishwasher; however, by dividing the heat recovery apparatus into the primary circulation system and the first secondary circulation system, it can be achieved on the one hand in an easily realized yet effective manner that the refrigerant fill level, i.e. the amount of refrigerant that circulates in the primary circulation system, can be limited to a minimum possible amount.

On the other hand, the solution according to the invention provides that the first secondary circulation system (and only the first secondary circulation system) comes into contact with the exhaust air of the dishwasher. The primary circulation system with hydrocarbon-based refrigerant is designed so as to be encapsulated by the exhaust system of the dishwasher, so that in case of leak or in case of leakage of refrigerant from the primary circulation system, there is no risk that the hydrocarbon-based refrigerant can collect, for example, in the sump of the dishwasher, which can lead to an explosion hazard.

In addition, with the solution according to the invention, it is possible to limit the refrigerant fill level to the minimum amount possible. The invention is based on the finding, among other things, that the lower the amount of refrigerant of the primary circulation system that can escape in the event of leakage or the like, the lower the risk that a combustible mixture can then form with the ambient air, which poses a significant safety risk.

The design according to the invention, in particular of the heat recovery apparatus, primarily aims to keep the overall structure of the actual heating pump as compact as possible. On the one hand, this includes using as small components as possible in terms of volume. On the other hand, however, this design focuses above all on adapting the basic functional concept of the heating pump such that the heating pump is as compact as possible and without the long refrigerant lines previously customary, especially to the liquid tank (e.g. washing tank) and/or to the drying unit.

In this respect, the invention is in particular also based on the finding that, in the heating pump concepts known today for commercial dishwashers for heating of machine zones, such as the washing zone, rinsing zone, and drying zone, the respective machine zones are always directly exposed to the hot refrigerant of the heating pump. This is done by directing the hot refrigerant via relatively long refrigerant lines from the vaporizer device including the compressor directly into a heat exchanger in the washing tank or optionally additionally in the drying unit. There, the hot refrigerant then releases the energy to the washing water or optionally additionally to the drying air and then passes through further relatively long refrigerant lines back to the vaporizer device.

In order to realize an efficient heat transfer in the washing tank, a heat exchanger (condenser) with a comparatively large heat exchange surface region of approximately 1.5 to 2 $m^2$ is required, which, due to the current operating principle of directly exposing the heat exchanger to refrigerant, involves a very high refrigerant fill level.

According to the invention proposed, the heating of the operating liquid of the dishwasher (rinsing liquid or washing liquid) or the drying air is no longer carried out directly by means of direct exposure to refrigerant in the respective treatment zone of the dishwasher, but rather by means of an additional secondary circulation. This makes it possible to design the entire heating pump as a small, compact unit, and especially a self-contained unit, for example on the roof of the conveyor dishwasher, without having to bring refrigerants directly to the consumers.

In the solution according to the invention, this is done by providing the (first) secondary circuit, here with the aid of a further carrier medium, for example water. The carrier medium in the heating pump assembly is heated to approximately 80° C. using a compact plate heat exchanger and then directed into the heat exchanger, for example in the washing tank, with the aid of an additional circulator pump, where it then outputs energy to the washing water, before it flows back into the heat exchanger, which is preferably configured as a plate exchanger, of the heating pump assembly and the circuit begins again.

Preferably, the secondary circuit is a closed secondary circuit.

According to a contemplated implementation of the dishwasher according to the invention, it is provided that the heating pump assembly of the primary circulation system is configured so as to transfer, via at least one heat exchanger unit of the heating pump assembly, at least a portion of the thermal energy transferred via the second heat exchanger unit of the first secondary circulation system to the refrigerant of the heating pump assembly of the primary circulation system circulating in the primary circulation system directly as utility heat to the at least one treatment liquid to be sprayed in the dishwasher and/or to the drying air.

It is contemplated that the heat exchanger unit of the heating pump assembly is arranged in a washing tank of the dishwasher and/or in a container for the temporary storage of rinsing liquid. Alternatively or additionally, the heat exchanger unit of the heating pump assembly can be arranged in a region where the drying air of the dishwasher is warmed.

As an alternative to a direct transfer of the recovered thermal energy as utility heat to the at least one treatment liquid to be sprayed in the dishwasher and/or to the drying air, it is contemplated that the heat recovery apparatus further comprises at least one second secondary circulation system which comprises a first heat exchanger unit, which is configured such that at least a portion of the thermal energy transferred to the refrigerant circulating in the primary circulation system of the heating pump assembly of the primary circulation system is or can be transferred into a fluid, in particular a liquid, carrier medium circulating in the second secondary circulation system. The second secondary circulation system can further comprise at least one second heat exchanger unit, which is configured such that at least a portion of the thermal energy transferred into the second secondary circulation system via the first heat exchanger unit of the second secondary circulation system is or can be transferred as a utility heat into the at least one treatment liquid to be sprayed in the dishwasher and/or to the drying air.

In principle, it is preferred that the heating pump assembly of the primary circulation system is configured separately from an exhaust system, in particular an exhaust duct system, of the dishwasher, via which the exhaust air is or can be discharged from the dishwasher during operation of the dishwasher, such that no duct system of the heating pump assembly of the primary circulation system, in which the refrigerant of the heating pump assembly of the primary circulation system is present or is circulating, is present in the exhaust system, in particular the exhaust duct system.

In other words, the heating pump assembly of the primary circulation system is preferably encapsulated with respect to the exhaust system/exhaust duct system of the dishwasher, and in particular is hermetically encapsulated.

In a contemplated implementation, in particular of the last mentioned design variant of the dishwasher according to the invention, it is provided that the heating pump assembly of the primary circulation system is at least partially or regionally, and preferably completely, accommodated in such a housing, wherein the housing is different from the machine housing of the dishwasher. At least one air exchange opening is preferably configured in the housing of the heating pump assembly, via which the interior of the housing is in fluid communication with the external atmosphere, and in particular with a room atmosphere of the set-up room of the dishwasher.

It is expedient here that the at least one air exchange opening of the housing of the heating pump assembly of the primary circulation system is preferably associated with at least one ventilator for forced ventilation of the housing, in particular as needed.

In preferred implementations of the dishwasher according to the invention, the refrigerant circulating in the primary circulation system is a natural refrigerant, in particular on the basis of hydrocarbons, and preferably a refrigerant that preferably is propane or isobutane, or comprises propane or isobutane. In this context, it is contemplated that the refrigerant of the primary circulation system is in particular a refrigerant belonging to the group R290A or R600A.

In addition, the mass of the refrigerant circulating in the primary circulation system can be drastically reduced and is a maximum of 400 g and in particular a maximum of 150 g.

The first and/or second secondary circulation system of the dishwasher according to the invention can be configured as a closed-loop circulation system. In particular, in these design variants, the carrier medium circulating in the first and second secondary circulation systems is a water-based carrier medium, in particular water.

As an alternative to the configuration of the first and second secondary circulation systems respectively as a closed-loop circulation system, it is also contemplated that at least the second secondary circulation system is configured as an open-loop circulation system, wherein the carrier medium circulating in the second secondary circulation system is a treatment liquid to be sprayed in the dishwasher, in particular a washing liquid or rinsing liquid.

In order for the respective carrier medium to circulate in the first and second secondary circulation systems, each secondary circulation system should be associated with a pump, which can be controlled in particular via a control device of the dishwasher, with which the carrier medium can be conveyed through the respective secondary circulation system as needed.

In contemplated implementations of the dishwasher according to the invention, in which the primary circulation system serves to transfer, via at least one heat exchanger unit of the heating pump assembly of the primary circulation system, at least a portion of the thermal energy transferred via the second heat exchanger unit of the first secondary circulation system to the refrigerant of the heating pump assembly of the primary circulation system circulating in the primary circulation system directly as utility heat into the at least one treatment liquid to be sprayed in the dishwasher and/or to the drying air, it is provided that the heating pump assembly of the primary circulation system is subdivided into a high-pressure region and a low-pressure region. Here, the heating pump assembly comprises the following:

- a vaporizer unit, which is associated with the low-pressure region of the heating pump assembly and configured such that at least a portion of the thermal energy transferred via the first heat exchanger unit of the first secondary circulation system to the carrier medium circulating in the first secondary circulation system is transferable to the refrigerant circulating in the primary circulation system, namely with simultaneous at least partial vaporizing of the refrigerant;
- a condenser unit, which is in fluid communication with the vaporizer unit and is configured so as to condense the refrigerant that has at least partially evaporated in the vaporizer unit to a higher pressure level;
- a liquefying unit associated with the high-pressure region of the heating pump assembly and being in fluid communication with the condenser unit and configured so as to liquefy at a high temperature the refrigerant condensed in the condenser unit, wherein at least a portion of the kinetic energy corresponding to the liquefaction temperature is transferred via the heat exchanger unit of the heating pump assembly directly as utility heat to the at least one treatment liquid to be sprayed in the dishwasher and/or to the drying air; and
- an expansion valve unit, which is in fluid communication with the liquefying unit and the vaporizer unit and is configured so as to decompress the refrigerant liquefied in the liquefying unit back to the vaporizing pressure.

In the alternative design variant of the dishwasher according to the invention, in which, in addition to the first secondary circulation system, at least one further second secondary circulation system is used, which comprises a second heat exchanger unit configured such that at least a portion of the thermal energy transferred via the first heat exchanger unit of the second secondary circulation system to the carrier medium circulating in the second secondary circulation system is transferred as a utility heat to the at least one treatment liquid to be sprayed in the dishwasher and/or to the drying air, it is also provided that the heating pump assembly of the primary circulation system is subdivided into a high-pressure region and a low-pressure region, wherein, however, the heating pump assembly comprises the following:

- a vaporizer unit, which is associated with the low-pressure region of the heating pump assembly and configured such that at least a portion of the thermal energy transferred via the first heat exchanger unit of the first secondary circulation system to the carrier medium circulating in the first secondary circulation system is transferable to the refrigerant circulating in the primary circulation system, namely with simultaneous at least partial vaporizing of the refrigerant;

a condenser unit, which is in fluid communication with the vaporizer unit and is configured so as to condense the refrigerant that has at least partially evaporated in the vaporizer unit to a higher pressure level;

a liquefying unit associated with the high-pressure region of the heating pump assembly and being in fluid communication with the condenser unit and configured so as to liquefy at a high temperature the refrigerant condensed in the condenser unit, wherein at least a portion of the kinetic energy corresponding to the liquefaction temperature is transferred via the first heat exchanger unit of the second secondary circulation system to the carrier medium circulating in the second secondary circulation system; and an expansion valve unit, which is in fluid communication with the liquefying unit and the vaporizer unit and is configured so as to decompress the refrigerant liquefied in the liquefying unit back to the vaporizing pressure.

According to preferred realizations of the dishwasher according to the invention, it is provided that the second secondary circulation system comprises a first heat exchanger unit that is in fluid communication with the heat exchanger unit of the heating pump assembly over a first branch line system, or can be in fluid communication as needed with the heat exchanger unit of the heating pump assembly using a first valve assembly, wherein the second secondary circulation system further comprises at least a second heat exchanger unit that is in fluid communication with the heat exchanger unit of the heating pump assembly over a second branch line system that is in particular parallel to the first branch line system, or can be in fluid communication as needed with the heat exchanger unit of the heating pump assembly using a second valve assembly.

The heating pump assembly is preferably configured as an exchangeable or replaceable module of the dishwasher.

Thus, the present invention also relates to a heating pump assembly as such, and not necessarily in combination with a dishwasher.

In this context, it is preferably provided in particular that the units of the heating pump assembly are accommodated in a separate housing, which is or can be arranged on the dishwasher such that the units of the heating pump assembly are accessible from the outside.

In particular, the heating pump assembly is configured as an exchangeable or replaceable module of the dishwasher. The module can preferably be placed on the roof of the dishwasher and is thus simply completely replaceable in case of a service event without the need for a refrigeration technician, because the refrigeration system no longer has to be opened for this purpose (as has been the case up to now).

Through the second secondary circuit, in particular by means of additional valve devices, a plurality of consumers or machine zones are approached in parallel in a simple to realize manner, so that the heating power can be divided as needed among one or more consumers without the need for complex circuits or controls in the cooling circuit.

BRIEF DESCRIPTION OF THE DRAWINGS

The invention is described in further detail below on the basis of an exemplary embodiment, with reference to the accompanying drawing, in which:

The sole FIGURE shows, schematically, an exemplary embodiment of the dishwasher according to the present invention, configured in this exemplary embodiment as a conveyor dishwasher.

DETAILED DESCRIPTION

In FIG. 1, as an example of the solution according to the invention, a conveyor dishwasher 1 is shown in a schematic longitudinal sectional view.

The exemplary embodiment of the conveyor dishwasher 1 shown in FIG. 1 comprises a pre-washing zone 11 as well as a main washing zone 12 located downstream of the pre-washing zone 11 when viewed in the conveying direction T of the washware. When viewed in the conveying direction T, in the conveyor dishwasher 1 shown in FIG. 1, downstream of the main washing zone 12, a post-washing or pre-rinsing zone 13 and a rinsing zone 14 are arranged.

When viewed in the conveying direction T, the washware received either directly on the conveyor belt or held by racks runs through an inlet tunnel 10, the subsequent pre-washing zone 11, the main washing zone 12, the post-washing or pre-rinsing zone 13, the rinsing zone 14, and through a drying zone 15, and into an outlet path 17.

Spraying nozzles are respectively associated with the aforementioned treatment zones 11, 12, 13, and 14 of the conveyor dishwasher 1, via which nozzles liquid is sprayed onto the washware conveyed by the conveyor belt through the respective treatment zones 11, 12, 13, and 14.

Although not shown in FIG. 1, it is preferred for the spraying nozzles, for example of the washing system associated with pre-washing zone 11 and main washing zone 12, to each be formed in an upper and lower washing tube such that corresponding washing arms are used in these treatment zones 11, 12. It is contemplated that the washing systems used comprise a plurality of washing tubes that form a washing arm battery, wherein the plurality of washing tubes are connected to a corresponding washing pump via a preferably common conduit system.

As indicated in FIG. 1, each washing zone (pre-washing zone 11, main washing zone 12, post-washing zone 13) is associated with a tank (washing tank 31, 32, 33) in which sprayed liquid is received and/or in which liquid is readied for the spraying nozzles of the relevant zones 11, 12, 13.

As used herein, the term "washing zone" generally refers to a treatment zone associated with a circulation tank (washing tank) and in which the liquid collected in the circulation tank of the treatment zone is circulated using a washing pump associated with the treatment zone. The term "washing zone" thus refers to the washing zone 11 and the main washing zone 12, but also a post-washing zone 13, which may be arranged downstream of the main washing zone 12 when viewed in the conveying direction T of the washware. The post-washing zone 13 is also sometimes referred to in the field of commercial washing as a "pump rinsing zone" or a "pre-washing zone." This is a circulation rinsing arranged upstream of the fresh water rinsing.

By contrast, the term "rinsing zone" as used herein is understood to mean a zone in which a fresh water rinsing takes place, in which the washware is sprayed with fresh water, which is optionally mixed with a rinse aid, in order to completely rid the washware of dirt particles and cleaning solution.

Thus, in the exemplary embodiment shown in FIG. 1, the final rinse takes place in the rinsing zone 14 before drying in the drying zone 15. The drying zone 15 is associated with a corresponding fan 21 in order to surround the cleaned washware with warm air and thereby dry it.

Furthermore, a control device 100 shown merely schematically in FIG. 1 is provided, which, in the embodiment of the invention shown (among other things), serves to control the respective washing pumps of the washing zones 11, 12, 13 appropriately during a washing process in order to supply washing liquid to the respective spraying nozzles at least temporarily via the associated conduit system.

In the conveyor dishwasher 1 shown in FIG. 1, rinsing liquid is sprayed onto the washware, not shown in FIG. 1, in the form of fresh water, which can be mixed with further chemical additives such as rinsing agents, via the spraying nozzles 2 of the rinsing zone 14 arranged above and below a conveyor belt. Although also not shown, laterally arranged spraying nozzles can also be provided in the rinsing zone 14.

A portion of the rinsing liquid sprayed in the rinsing zone 14 is conveyed from zone to zone in a cascading system counter to the conveying direction T of the washware. The remaining portion is guided directly into the pre-washing tank 31 of the pre-washing zone 11 via a valve and a bypass conduit (not shown).

The rinsing liquid sprayed in the rinsing zone 14 is collected in the tank (post-washing or pre-rinsing tank 33) of the post-washing or pre-rinsing zone 13, from which it is conveyed to the spraying nozzles 3 (post-washing or pre-rinsing nozzles) of the post-washing or pre-rinsing zone 13 via the washing pump belonging to the washing system of the post-washing or pre-rinsing zone 13. In the post-washing or pre-rinsing zone 13, washing liquid is rinsed off of the washware.

The liquid accumulating here flows into the washing tank 32 of the main washing zone 12, and a cleaning agent is typically added, and then the liquid is sprayed onto the washware via the spraying nozzles (washing nozzles) of the washing system belonging to the main washing zone 12 using a washing pump belonging to the washing system of the main washing zone 12.

From the washing tank 32 of the main washing zone 12, the washing liquid then flows into the pre-washing tank 31 of the pre-washing zone 11. In the pre-washing zone 11, with the aid of a washing pump belonging to the washing system of the pre-washing zone 11, the washing liquid collected in the pre-washing tank 31 is sprayed on the washware via the spraying nozzles (pre-washing nozzles) of the washing system belonging to the pre-washing zone in order to remove coarse soiling from the washware.

It is contemplated here that a portion of the washing liquid sprayed in the main washing zone 12 enters the washing tank (pre-washing tank 31) of the pre-washing zone 11 via an overflow system. Like the main washing zone 12, the pre-washing zone 11 can be equipped with a tank cover screen configured as a flat screen. This tank cover screen is preferably arranged above the washing tank (pre-washing tank 31) of the pre-washing zone 11 in order to separate dirt particles from the washing liquid sprayed in the pre-washing zone 11 and flowing back into the pre-washing tank 31 due to gravity. The mesh size of the tank cover screen is preferably in a range between approximately 1 mm and 4 mm.

The heated washing and rinsing liquid creates steam plumes (vapor) when sprayed within the washing and rinsing zones 11, 12, 13, 14 of the conveyor dishwasher 1. In order to prevent the escape of these steam plumes from the conveyor dishwasher 1, it is advantageous if, in the embodiment shown schematically in FIG. 1, the individual treatment zones, in particular the washing and rinsing zones 11, 12, 13, 14, are separated with curtains.

To extract the steam plumes (vapor) created during operation of the conveyor dishwasher 1 as well as the wet, warm air from the interior of the conveyor dishwasher 1, the conveyor dishwasher 1 is equipped with a machine-side exhaust system 20, which is designed so as to discharge at least a majority of the warm and moist air created during operation of the conveyor dishwasher 1 in the treatment zones 11, 12, 13, 14 as exhaust air from the respective treatment zones 11, 12, 13, 14 of the machine.

In the embodiment of the conveyor dishwasher 1 according to the invention shown in FIG. 1, the central exhaust system 20 is arranged in the region of post-washing or pre-rinsing zone 13 and rinsing zone 14. In the illustrated embodiment, the exhaust system 20 comprises a single exhaust fan 4, which is controllable via the control device 100 in order to be able to adjust the flow rate of the exhaust fan 4.

The exhaust system 20 is further associated with an exhaust air heat recovery system, which can preferably also be controlled via the control device 100 and serves to continuously, or as needed, draw thermal energy from the exhaust air to be discharged from the conveyor dishwasher 1 with the exhaust system 20 and thus cool the exhaust air to be discharged from the conveyor dishwasher 1.

The heat recovery system used in the exemplary embodiment of the conveyor dishwasher 1 shown schematically in FIG. 1 will be described in further detail below.

Specifically, in the embodiment shown in FIG. 1, the heat recovery system and/or the heat recovery apparatus are configured as an exhaust air heat recovery apparatus. However, it is also contemplated to use the heat recovery apparatus as a wastewater heat recovery apparatus.

The heat recovery apparatus (heat recovery system) used for the exhaust air heat recovery in FIG. 1 serves for energy recovery (and thus for conserving resources in the operation of the conveyor dishwasher 1) and in particular eliminate the need for on-site exhaust air output installations.

For this purpose, the embodiment of the conveyor dishwasher 1 according to the invention as shown schematically in FIG. 1 comprises the heat recovery apparatus (heat recovery system) already mentioned and configured as an exhaust air heat recovery system, which operates according to the principle of heat pumping technology.

The heat recovery apparatus (heat recovery system) is divided into a primary circulation system 5 with a heating pump assembly on one hand and a first as well as a second secondary circulation system 6, 7 on the other. The first secondary circulation system 6 comprises a first heat exchanger unit 22, which is arranged in the exhaust system 20 of the conveyor dishwasher 1 and is configured such that at least a portion of the energy to be recovered from the exhaust air is or can be transferred into a fluid, in particular a liquid, carrier medium circulating in the first secondary circulation system 6.

The first secondary circulation system 6 comprises a further, second heat exchanger unit 23, which is configured such that at least a portion of the thermal energy transferred to the carrier medium circulating in the first secondary circulation system 6 via the first heat exchanger unit 22 of the first secondary circulation system 6 is or can be transferred into a refrigerant circulating in the primary circulation system 5 of the heating pump assembly of the primary circulation system 5.

The second secondary circulation system 7 of the heat recovery apparatus comprises a first heat exchanger unit 24, which is configured such that at least a portion of the thermal energy transferred to the refrigerant circulating in the primary circulation system 5 of the heating pump assembly of the primary circulation system 5 is or can be transferred into a fluid, in particular a liquid, carrier medium circulating in the second secondary circulation system 7.

The second secondary circulation system 7 further comprises at least one second heat exchanger unit 25, which is configured such that at least a portion of the thermal energy transferred into the second secondary circulation system 7 via the first heat exchanger unit 24 of the second secondary circulation system 7 is or can be transferred as a utility heat into the washing liquid to be sprayed in the dishwasher 1.

It is provided here that the heating pump assembly of the primary circulation system 5 is configured separately from the exhaust system 20 of the dishwasher 1 such that no duct system of the heating pump assembly of the primary circulation system 5, in which the refrigerant of the heating pump assembly of the primary circulation system 5 is present or circulates, is present in the exhaust system 20.

In particular, the heating pump assembly is designed so as to be encapsulated with respect to the exhaust system 20 of the dishwasher 1 and in particular hermetically encapsulated.

Although not shown in FIG. 1, it is preferred that the heating pump assembly is at least partially or regionally, and preferably completely, accommodated in a housing. At least one air exchange opening can be configured in the housing, via which the interior of the housing is in fluid communication with the external atmosphere, and in particular with a room atmosphere of the set-up room of the conveyor dishwasher 1. In this context, it is contemplated that the at least one air exchange opening of the housing of the heating pump assembly is associated with at least one ventilator for forced ventilation of the housing, in particular as needed.

The refrigerant circulating in the primary circulation system 5 is in particular a natural refrigerant, preferably based on hydrocarbons. This is preferably a refrigerant that either is propane or isobutane or contains propane or isobutane. In particular, a refrigerant belonging to the group R290A or R600A is expedient.

The mass of the refrigerant circulating in the primary circulation system 5 is preferably a maximum of 150 g.

In the embodiment of the conveyor dishwasher 1 according to the invention shown in FIG. 1, both the first and second secondary circulation systems 6, 7 are respectively configured as a closed-loop circulation system.

However, it is also contemplated in this context that the second secondary circulation system 7 is configured as an open-loop secondary circulation system, wherein the carrier medium circulating in the second secondary circulation system 7 is a treatment liquid to be sprayed in the conveyor dishwasher 1, in particular washing liquid or rinsing liquid.

In principle, the carrier medium circulating in the first and second secondary circulation systems 6, 7 is a water-based carrier medium or water.

It can further be seen in the illustration in FIG. 1 that both the first secondary circulation system 6 and the second secondary circulation system 7 are each associated with a pump 27, which can be controlled via the control device 100 of the conveyor dishwasher 1 and with which the carrier medium (water) can be conveyed by the first and second secondary circulation system 6, 7, respectively.

Although it is shown in FIG. 1 that the second heat exchanger unit 25 of the second secondary circulation system 7 is arranged in the washing tank 32 of the conveyor dishwasher 1, it is contemplated that the second heat exchanger unit 25 of the second secondary circulation system 7 is also arranged in the fresh water tank 33 of the conveyor dishwasher 1 and/or in a region for the heating of drying air.

In particular, the second secondary circulation system 7 can comprise a plurality of second heat exchanger units 25, which are supplied with the heated carrier medium (water) of the second secondary circulation system 7 via corresponding valves, as needed.

The heating pump assembly of the primary circulation system 5 is subdivided into a high-pressure region and a low-pressure region.

A vaporizer unit, which is associated with the low-pressure region of the heating pump assembly and configured such that at least a portion of the thermal energy transferred via the first heat exchanger unit 22 of the first secondary circulation system 6 to the carrier medium (water) circulating in the first secondary circulation system 6 is transferable to the refrigerant circulating in the primary circulation system 5, namely with simultaneous at least partial vaporizing of the refrigerant.

A condenser unit 9 is in fluid communication with the vaporizer unit and is configured so as to condense the refrigerant that has at least partially evaporated in the vaporizer unit to a higher pressure level.

A liquefying unit is associated with the high-pressure region of the heating pump assembly and is in fluid communication with the condenser unit 9 and configured so as to liquefy at a high temperature the refrigerant condensed in the condenser unit 9, wherein at least a portion of the kinetic energy corresponding to the liquefaction temperature is transferred via the first heat exchanger unit 24 of the second secondary circulation system 7 to the carrier medium circulating in the second secondary circulation system 7.

An expansion valve unit 10 is in fluid communication with the liquefying unit and the vaporizer unit and is configured so as to decompress the refrigerant liquefied in the liquefying unit back to the vaporizing pressure.

The invention is not limited to the conveyor dishwasher 1 shown in FIG. 1, but rather results from a summary of all features disclosed herein.

In particular, the heat recovery system described above according to the invention or the heat recovery apparatus described above according to the invention can also be used with corresponding box-type dishwashers.

The invention further relates to a heat recovery apparatus as such, wherein the heat recovery apparatus is configured so as to recover at least a portion of the thermal energy of the exhaust air discharged or to be discharged from the dishwasher 1 as utility heat during operation of the dishwasher 1 and to transfer said thermal energy to at least one treatment liquid to be sprayed in the dishwasher 1, in particular washing liquid and/or rinsing liquid, and/or to a drying air used for drying in the dishwasher 1.

Alternatively, the heat recovery apparatus is configured so as to recover at least a portion of the thermal energy of the wastewater discharged or to be discharged from the dishwasher 1 as utility heat during operation of a dishwasher 1 and to transfer said thermal energy to at least one treatment liquid to be sprayed in the dishwasher 1, in particular washing liquid and/or rinsing liquid, and/or to a drying air used for drying in the dishwasher 1.

The heat recovery apparatus comprises a primary circulation system 5 having a heating pump assembly and a first secondary circulation system 6, wherein the first secondary circulation system 6 comprises a first heat exchanger unit 22, which is configured such that at least a portion of the energy to be recovered from the exhaust air is transferred or transferable to a fluid, in particular liquid, carrier medium circulating in the first secondary circulation system 6, wherein the first secondary circulation system 6 comprises a second heat exchanger unit 23, which is configured such that at least a portion of the energy transferred via the first heat exchanger unit 22 of the first secondary circulation system 6 to the carrier medium circulating in the first secondary circulation system 6 is transferred or transferable as utility heat for warming the at least one treatment fluid to be sprayed in the dishwasher 1 and/or for warming the drying air to a refrigerant of the heating pump assembly of the primary circulation system 5, said drying air circulating in the primary circulation system 5.

The heat recovery apparatus can further comprise at least one secondary circulation system 7, which comprises a first heat exchanger unit 24, which is configured such that at least a portion of the thermal energy transferred to the refrigerant of the heating pump assembly of the primary circulation system 5 circulating in the primary circulation system 5 is transferred or transferable to a fluid, in particular liquid, carrier medium circulating in the second secondary circulation system 7, wherein the second secondary circulation system 7 comprises at least one second heat exchanger unit 25, which is configured such that at least a portion of the thermal energy transferred via the first heat exchanger unit 24 of the second secondary circulation system 7 to the carrier medium circulating in the second secondary circulation system 7 is transferred or transferable as utility heat to the at least one treatment liquid to be sprayed in the dishwasher 1 and/or to the drying air.

LIST OF REFERENCE NUMERALS

1 Dishwasher/conveyor dishwasher
2 Spray nozzles
3 Spray nozzles
4 Exhaust fan
5 Primary circulation system
6 First secondary circulation system
7 Second secondary circulation system
9 Condenser unit of the heating pump assembly
10 Expansion valve unit of the heating pump assembly
11 Pre-washing zone
12 Main washing zone
13 Post-washing or pre-rinsing zone
14 Rinsing zone
15 Drying zone
17 Outlet path
20 Exhaust system
21 Fan
22 First heat exchanger unit of the first secondary circulation system
23 Second heat exchanger unit of the first secondary circulation system
24 First heat exchanger unit of the second secondary circulation system
25 Second heat exchanger unit of the second secondary circulation system
27 Pump of the secondary circulation system
31 Pre-washing tank
32 Washing tank
33 Post-washing tank
100 Control device
T Conveying direction

The invention claimed is:

1. A dishwasher, wherein the dishwasher comprises a heat recovery apparatus, which is configured so as to recover at least a portion of the thermal energy of the exhaust air discharged, or to be discharged, from the dishwasher as utility heat during operation of the dishwasher and to transfer said thermal energy to at least one treatment liquid, to be sprayed in the dishwasher and/or to a drying air used for drying in the dishwasher, wherein the heat recovery apparatus comprises a primary circulation system having a heating pump assembly and a first secondary circulation system, wherein the first secondary circulation system comprises a first heat exchanger unit, which is configured such that at least a portion of the energy to be recovered from the exhaust air is transferred or transferable to a fluid carrier medium circulating in the first secondary circulation system, wherein the first secondary circulation system comprises a second heat exchanger unit, which is configured such that at least a portion of the energy transferred via the first heat exchanger unit of the first secondary circulation system to the carrier medium circulating in the first secondary circulation system is transferred or transferable as utility heat for warming the at least one treatment fluid to be sprayed in the dishwasher and/or for warming the drying air to a refrigerant of the heating pump assembly of the primary circulation system, said drying air circulating in the primary circulation system.

2. The dishwasher according to claim 1, wherein the heating pump assembly of the primary circulation system is configured so as to transfer, via at least one heat exchanger unit of the heating pump assembly, at least a portion of the thermal energy transferred via the second heat exchanger unit of the first secondary circulation system to the refrigerant of the heating pump assembly of the primary circulation system circulating in the primary circulation system directly as utility heat to the at least one treatment liquid to be sprayed in the dishwasher and/or to the drying air.

3. The dishwasher according to claim 2, wherein the heating pump assembly of the primary circulation system is subdivided into a high pressure region and a low pressure region, and wherein the heating pump assembly of the primary circulation system comprises the following:

a vaporizer unit, which is associated with the low-pressure region of the heating pump assembly and configured such that at least a portion of the thermal energy transferred via the first heat exchanger unit of the first secondary circulation system to the carrier medium circulating in the first secondary circulation system is transferable to the refrigerant circulating in the primary circulation system, namely with simultaneous at least partial vaporizing of the refrigerant;

a condenser unit, which is in fluid communication with the vaporizer unit and is configured so as to condense the refrigerant that has at least partially evaporated in the vaporizer unit to a higher pressure level;

a liquefying unit associated with the high-pressure region of the heating pump assembly and being in fluid communication with the condenser unit and configured so as to liquefy at a high temperature the refrigerant condensed in the condenser unit, wherein at least a portion of the kinetic energy corresponding to the liquefaction temperature is transferred via the heat exchanger unit of the heating pump assembly directly as utility heat to the at least one treatment liquid to be sprayed in the dishwasher and/or to the drying air; and an expansion valve unit, which is in fluid communication with the liquefying unit and the vaporizer unit and is configured so as to decompress the refrigerant liquefied in the liquefying unit back to the vaporizing pressure.

4. The dishwasher according to claim 1, wherein the heat recovery apparatus further comprises at least one secondary circulation system, which comprises a first heat exchanger unit, which is configured such that at least a portion of the thermal energy transferred to the refrigerant of the heating pump assembly of the primary circulation system circulating in the primary circulation system is transferred or transferable to a fluid carrier medium circulating in the second secondary circulation system, wherein the second secondary circulation system comprises at least one second heat exchanger unit, which is configured such that at least a portion of the thermal energy transferred via the first heat exchanger unit of the second secondary circulation system to the carrier medium circulating in the second secondary circulation system is transferred or transferable as utility heat to the at least one treatment liquid to be sprayed in the dishwasher and/or to the drying air.

5. The dishwasher according to claim 4, and at least according to claim 3, wherein the secondary circulation system is configured as an open-loop circulation system, and wherein the carrier medium circulating in the secondary circulation system is a treatment liquid to be sprayed in the dishwasher.

6. The dishwasher according to claim 4, wherein the at least one second heat exchanger unit of the second secondary circulation system is arranged in a washing tank of the dishwasher, in a fresh water tank of the dishwasher, and/or in a region for heating drying air.

7. The dishwasher according to claim 4, wherein the heating pump assembly of the primary circulation system is subdivided into a high pressure region and a low pressure region, and wherein the heating pump assembly of the primary circulation system comprises the following:

a vaporizer unit, which is associated with the low-pressure region of the heating pump assembly and configured such that at least a portion of the thermal energy transferred via the first heat exchanger unit of the first secondary circulation system to the carrier medium circulating in the first secondary circulation system is transferable to the refrigerant circulating in the primary circulation system, namely with simultaneous at least partial vaporizing of the refrigerant;

a condenser unit, which is in fluid communication with the vaporizer unit and is configured so as to condense the refrigerant that has at least partially evaporated in the vaporizer unit to a higher pressure level;

a liquefying unit associated with the high-pressure region of the heating pump assembly and being in fluid communication with the condenser unit and configured so as to liquefy at a high temperature the refrigerant condensed in the condenser unit, wherein at least a portion of the kinetic energy corresponding to the liquefaction temperature is transferred via the first heat exchanger unit of the second secondary circulation system to the carrier medium circulating in the second secondary circulation system; and an expansion valve unit, which is in fluid communication with the liquefying unit and the vaporizer unit and is configured so as to decompress the refrigerant liquefied in the liquefying unit back to the vaporizing pressure.

8. The dishwasher according to claim 1, wherein the heating pump assembly of the primary circulation system is configured separately from an exhaust system of the dishwasher, via which the exhaust air is discharged or dischargeable from the dishwasher during operation of the dishwasher, such that no duct system of the heating pump assembly of the primary circulation system, in which the refrigerant of the heating pump assembly of the primary circulation system is present or is circulating, is present in the exhaust system.

9. The dishwasher of claim 8, wherein:

the heating pump assembly is hermetically encapsulated with respect to the exhaust system of the dishwasher; and/or the heating pump assembly is completely accommodated in a housing, wherein at least one air exchange opening is formed in the housing, via which the interior of the housing is in fluid communication with the external atmosphere, wherein the at least one air exchange opening of the housing of the heating pump assembly is associated with at least one ventilator for forced ventilation of the housing.

10. The dishwasher according to claim 1, wherein the refrigerant circulating in the primary circulation system is a natural refrigerant, on the basis of hydrocarbons, and wherein the mass of the refrigerant circulating in the primary circulation system is at most 1000 g.

11. The dishwasher according to claim 1, wherein the at least one secondary circulation system is configured as a closed-loop circulation system.

12. The dishwasher according to claim 11, wherein the carrier medium circulating in the at least one secondary circulation system is a water-based carrier medium or is water.

13. The dishwasher according to claim 1, wherein the at least one secondary circulation system comprises a pump, which is controlled by a control device of the dishwasher, with which the carrier medium can be conveyed through the at least one secondary circulation system as needed.

14. The dishwasher according to claim 1, wherein the dishwasher is configured as a conveyor dishwasher having a conveying apparatus for conveying the dishes through the individual treatment zones of the conveyor dishwasher, wherein the conveyor dishwasher comprises at least one washing zone, in which washing liquid from a washing tank associated with at least one washing zone is sprayed onto the dishes, wherein the conveyor dishwasher further comprises at least one rinsing zone arranged downstream from the at least one washing zone when viewed in the conveying direction of the dishes, in which rinsing liquid is sprayed onto the dishes, and wherein the conveyor dishwasher further comprises an exhaust system for discharging exhaust air from the conveyor dishwasher.

15. The dishwasher of claim 1, wherein the heating pump assembly of the primary circulation system is configured as an exchangeable or replaceable module of the dishwasher.

16. A heat recovery apparatus for a dishwasher, wherein the heat recovery apparatus is configured so as to recover at least a portion of the thermal energy of the exhaust air discharged, or to be discharged, from the dishwasher as utility heat during operation of the dishwasher and to transfer said thermal energy to at least one treatment liquid to be sprayed in the dishwasher and/or to a drying air used for drying in the dishwasher, wherein the heat recovery apparatus comprises a primary circulation system having a heating pump assembly and a first secondary circulation system, wherein the first secondary circulation system comprises a first heat exchanger unit, which is configured such that at least a portion of the energy to be recovered from the exhaust air is transferred or transferable to a fluid carrier medium circulating in the first secondary circulation system, wherein the first secondary circulation system comprises a second heat exchanger unit, which is configured such that at least a portion of the energy transferred via the first heat exchanger unit of the first secondary circulation system to the carrier medium circulating in the first secondary circulation system is transferred or transferable as utility heat for warming the at least one treatment fluid to be sprayed in the dishwasher and/or for warming the drying air to a refrigerant of the heating pump assembly of the primary circulation system, said drying air circulating in the primary circulation system.

17. The heat recovery apparatus according to claim 16, wherein the heat recovery apparatus further comprises at least one secondary circulation system, which comprises a first heat exchanger unit, which is configured such that at least a portion of the thermal energy transferred to the refrigerant of the heating pump assembly of the primary circulation system circulating in the primary circulation system is transferred or transferable to a fluid carrier medium circulating in the second secondary circulation system, wherein the second secondary circulation system comprises at least one second heat exchanger unit, which is configured such that at least a portion of the thermal energy transferred via the first heat exchanger unit of the second secondary circulation system to the carrier medium circulating in the second secondary circulation system is transferred or transferable as utility heat to the at least one treatment liquid to be sprayed in the dishwasher and/or to the drying air.

* * * * *